US005370316A

United States Patent [19]

Lancaster

[11] Patent Number: 5,370,316

[45] Date of Patent: Dec. 6, 1994

[54] SPRAY HEAD ASSEMBLY

[76] Inventor: S. Spear Lancaster, 1188 Bacon Ridge Rd., Crownsville, Md. 21132

[21] Appl. No.: 177,766

[22] Filed: Jan. 4, 1994

[51] Int. Cl.[5] ..... B05B 9/00

[52] U.S. Cl. ..... 239/530; 239/562; 239/586; 239/588; 251/229; 251/251

[58] Field of Search ..... 239/525, 530, 562, 586, 239/588; 251/229, 251

[56] References Cited

U.S. PATENT DOCUMENTS

| | | | |
|---|---|---|---|
| D. 282,394 | 1/1986 | Ettlinger | D23/37 |
| 990,179 | 4/1911 | Wilson . | |
| 992,375 | 5/1911 | Moffitt | 251/229 |
| 2,469,642 | 5/1949 | Grewe . | |
| 2,499,318 | 2/1950 | Jungerhans | 251/229 |
| 2,678,848 | 5/1954 | Grewe et al. . | |
| 2,884,206 | 4/1959 | Dukes . | |
| 3,006,559 | 10/1961 | Schmidt . | |
| 3,022,015 | 2/1962 | Burch . | |
| 3,131,868 | 5/1964 | Coleman . | |
| 3,214,133 | 10/1965 | Rodgers et al. . | |
| 3,559,947 | 2/1971 | Sette | 251/147 |
| 3,637,143 | 1/1972 | Shames et al. . | |
| 4,124,164 | 11/1978 | Bachman | 239/533.15 |
| 4,527,743 | 7/1985 | Ettlinger et al. | 239/530 |
| 4,607,795 | 8/1986 | Ettlinger et al. | 239/530 |
| 4,629,124 | 12/1986 | Gruber | 239/586 |

*Primary Examiner*—Kevin P. Shaver
*Assistant Examiner*—Christopher G. Trainor
*Attorney, Agent, or Firm*—Griffin Butler Whisenhunt & Kurtossy

[57] ABSTRACT

A spring-biased actuator lever arm (44) of a spray head assembly (10) has an actuator shaft (42) which extends into a sealed spray-head compartment (20) for sliding a cam (70) to move a cam follower (72) and thereby open a poppet valve (76) positioned inside a water supply passageway (22) for opening the poppet valve against a return spring (84) and the flow of water toward the spray-head compartment.

8 Claims, 2 Drawing Sheets

SPRAY HEAD ASSEMBLY

BACKGROUND OF THE INVENTION

This invention relates generally to the art of spray head assemblies and more particularly to spray head assemblies used on, or in connection with, dishwashing installations.

A spray head assembly that relates to this invention is described in U.S. Pat. No. 4,527,743 to Ettlinger et al. The spray head assembly described in that patent includes a seesaw actuator lever arm having an actuator shaft which extends into a water-sealed spray-head compartment from which water is sprayed through spray pores. The actuator lever arm is pivoted so that the actuator shaft slides a sliding valve plate in the water-sealed spray-head compartment to allow pressurized water from a supply pipe to enter the spray-head compartment through a hole in the sliding valve plate. In this patent, the actuator lever arm is elongated and extends along the supply pipe, with a handle of the actuator lever arm being adjacent to the pipe. In order to turn on the spray head assembly of the Ettlinger et al. device the handle is squeezed toward the supply pipe. The actuator lever pivots to move the actuator shaft thereof in the spray-head compartment and to also move the sliding valve plate laterally which, in turn, registers the hole of the valve plate with a water-supply passage of the supply pipe, thereby allowing water to enter the spray-head compartment and be sprayed from the spray pores.

Although the spray head assembly of the Ettlinger et al. patent has many advantages over prior art spray head assemblies for washing dishes and the like, it has the problem that the sliding valve plate does not adequately seal the mouth of the water-supply passageway when the spray head assembly is not turned on. That is, water pressure within the water-supply passageway of the supply pipe can get around the sliding valve plate and can either pass through a rubber, sealing, bulkhead or drip from the spray pores of the spray-head compartment, neither of which is desirable. Although attempts have been made to improve the mechanism of Ettlinger et al. so that the sliding valve plate forms a better seal at the mouth of the supply pipe, to date such efforts have not resulted in a totally satisfactory mechanism. Although one attempt to improve the seal did help control the water, it unduly increased the amount of force required to actuate the actuator lever arm in order to slide the valve plate.

In any event, it is an object of this invention to provide a spray head assembly for use in dishwashing and the like which more positively controls, both cutting on and cutting off, water coming from a supply pipe without the necessity of an operator using an undue force to actuate it.

Further, it is an object of this invention to provide a spray head assembly as mentioned in the previous paragraph which is relatively uncomplicated in structure and which can be manufactured in a relatively cost-effective manner.

SUMMARY

According to principles of this invention, an actuator shaft of an elongated actuator lever arm extends into a sealed spray-head compartment where it slides a cam longitudinally to actuate a cam follower for opening a popper valve in a water-supply passageway against a flow of water. The actuator lever arm extends along a water-supply pipe defining the water-supply passageway with a handle thereof being adjacent the pipe and therefore extending in the same direction as movement of the poppet valve.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear mariner.

DESCRIPTION OF THE PREFERRED EMBODIMENT

Figure 1:
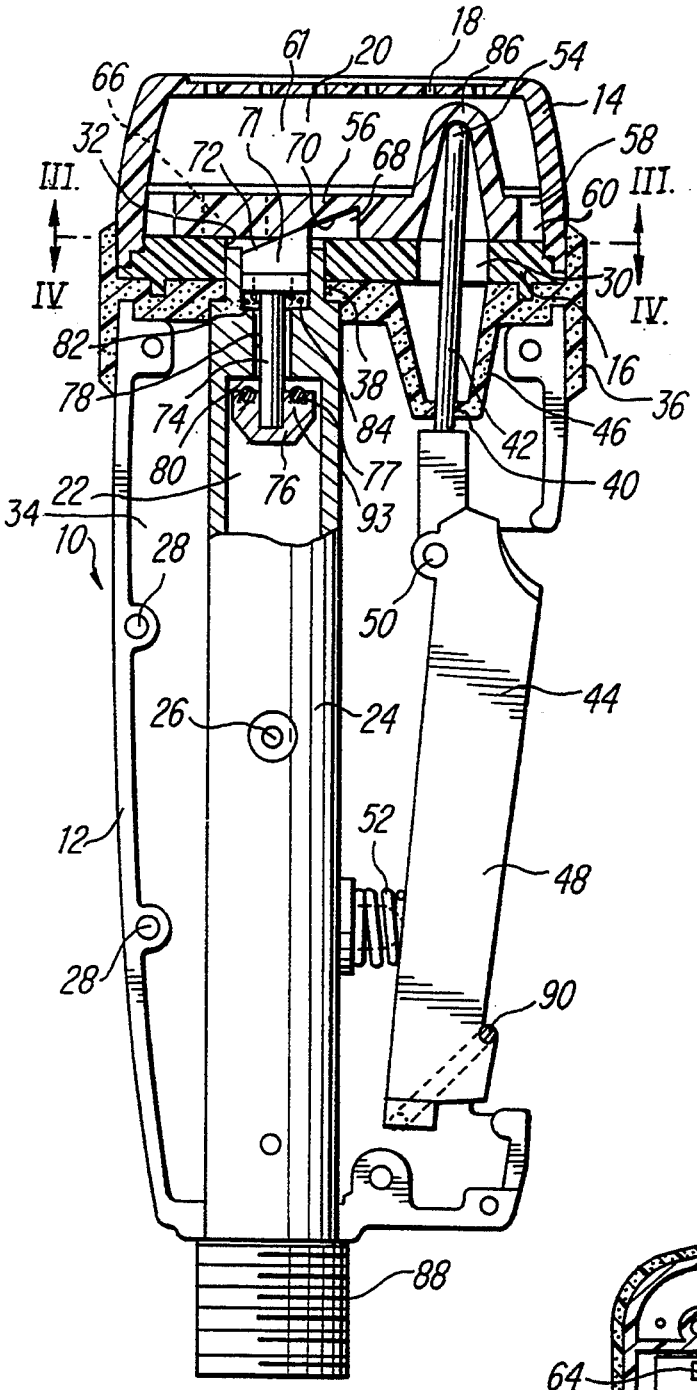
FIG. 1 is a side elevational, partially cutaway, view of a spray head assembly of this invention with a housing shell half being removed to expose important elements of the invention, with a handle of an actuator lever arm thereof being partially depressed.
Figure 2:
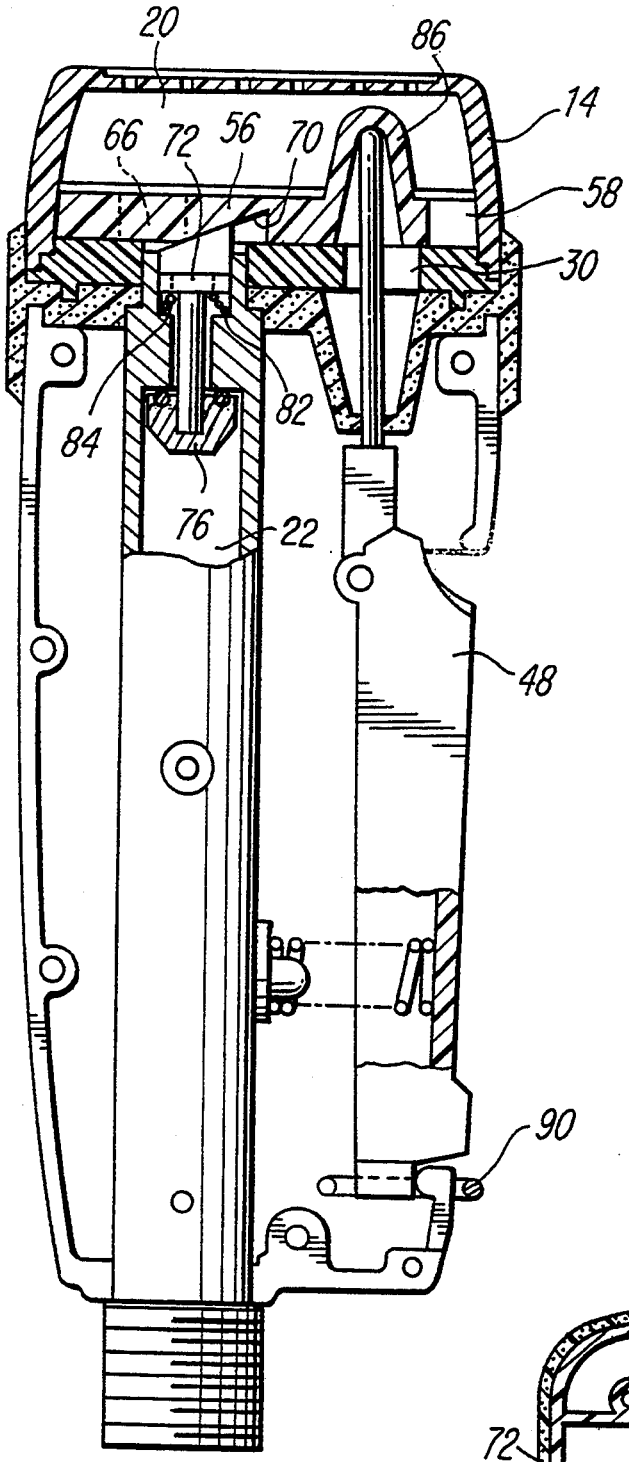
FIG. 2 is view similar to FIG. 1 but with the handle of the actuator lever arm thereof not being depressed.

A spray head assembly 10 comprises a housing shell 12, which actually includes two complementary shell halves but in FIGS. 1 and 2 the shell half closest to an observer has been removed to expose working parts of the spray head assembly, and an inverted pot-shaped spray-head compartment plate 14 which is separated from the housing shell 12 by a cam-support plate 16. The spray-head compartment plate 14 is formed of one piece and it, the two-piece housing shell 12, and the cam-support plate 16 are all formed of a rather rigid plastic. The spray-head compartment plate 14 has spray pores, or holes, 18 therein through which water supplied to a spray-head compartment 20 through a water-supply passageway 22 of a water-supply pipe 24 flows. The water-supply pipe 24 is held in place between the two halves of the housing shell 12 by means of studs 26 which extend into indentations in the housing shell 12 when the two halves thereof are bolted together at bolt holes 28.

Figure 4:
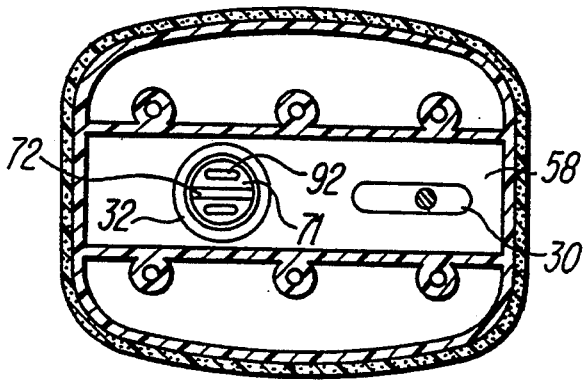
FIG. 4 is a cross-sectional view taken on line IV—IV in FIG. 1.

As can be seen in FIG. 4, there are two passageways through the cam-support plate 16, namely, an actuator-shaft slot 30 and a water-supply pipe hole 32; however, water is prevented from passing from the spray-head compartment 20 to an interior 34 of the housing shell 12 by means of a rubber seal, or bulkhead, 36 which is seated between the cam-support plate 16 and the housing shell 12 to surround and seal these two passageways. The bulkhead 36 has a hole 38 therein through which the water-supply pipe 24 sealingly extends and a hole 40 through which an actuator shaft 42 of an actuator lever arm 44 sealingly extends. That portion of the bulkhead 36 forming the actuator-shaft hole 40 is in the shape of a domed boot 46 to allow relatively easy lateral movement of the actuator shaft 42.

The actuator lever arm 44 includes a plastic handle 48 which is rigidly attached to the metallic actuator shaft 42 so that the actuator lever arm 44 is one rigid member which is mounted to the housing shell 12 at a pivot 50. The actuator lever arm 44 is spring loaded by a spring 52 to rotate in a counterclockwise direction as seen in FIGS. 1 and 2. In FIG. 1, the handle 48 is partially depressed and an outer tip 54 of the actuator shaft 42 is, therefore, moved somewhat to the right as seen in the drawings.

Figure 3:
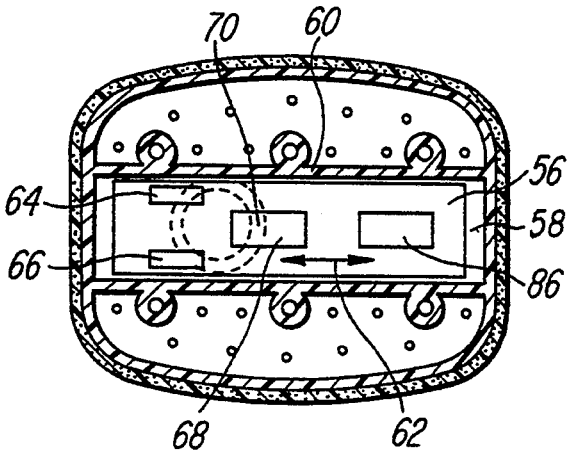
FIG. 3 is a cross-sectional view taken on line III—III in FIG. 1.

The spray head assembly 10 further comprises a cam plate 56 of rigid plastic which slides in a track 58 formed on top of the cam-support plate 16. In this respect, track walls 60 define the track 58 along which the cam plate 56 travels, as indicated by a two-headed arrow 62 in FIG. 3, while lower edges of compartment-plate walls 61 hold the cam plate 56 close to a top surface at the cam support plate 16. In this regard the cam plate 56 rides on the top surface of the cam-support plate 16, between the walls 60 formed thereon and the compartment-plate walls 61, and has two holes 64, 66 therethrough. In addition, on a bottom side of the cam plate 56, there is a cam recess 68 which is partially defined by a slanted, or bevelled, cam surface 70 into which a cam follower 71 having a cam-follower surface 72 extends. The cam-follower surface 72 contacts the cam surface 70 such that when the cam plate 56 is moved to the right as seen in FIGS. 1 and 2 the cam follower 71 is moved downwardly. As can be seen in the drawings, the cam follower 71 is integral with a cam-follower shaft 74 which is, in turn, fixedly attached to a poppet valve 76 having a sealing O-ring 77 on an upwardly directed seat surface thereof. In this regard, the cam-follower shaft 74 extends through a valve-seat portion 78 of the water-supply passageway 22. The valve-seat portion 78 is restricted so as to form a valve seat 80 on a bottom surface thereof and a spring abutment 82 on a top surface thereof. A spring 84 contacts the spring abutment 82 and the cam follower 71 to bias the poppet valve 76 toward the closed position against the valve-seat surface 80, as is depicted in FIG. 2.

The cam plate 56 also includes a socket 86 for receiving the outer tip 54 of the actuator shaft 42 and remaining substantially in contact therewith. Thus, when the actuator shaft 42 is moved to the right as shown in FIG. 1, the cam plate 56 is also moved to the right, also as is shown in FIG. 1.

In operation, the spray head assembly is assembled as set forth above. In this respect, this structures is somewhat similar to the structure described in U.S. Pat. No. 4,527,743 to Ettlinger et al., however, there are very important differences between these two structures which are set forth above. Where a common structure which is described in Ettlinger is not indicated above, the description in the Ettlinger et al. patent is incorporated herein by reference.

The cam follower 71 and the cam-follower shaft 74 are molded of a relatively rigid plastic as one integral part whereas the poppet valve 76 is molded as a separate, more resilient, member. In order to assemble these parts on the valve-seat portion 78 of the water-supply pipe 24 forming the valve-seat surface 80 and the spring abutment 82, the spring 84 is placed on the cam-follower shaft 74 which is then inserted through the valve-seat portion 78 of the water-supply passage 22. The lower tip of the cam-follower shaft 74 is inserted into a hole in the poppet valve 76 where it is attached thereto. In one embodiment this attachment is accomplished by a press fit. Water pressure tends to hold the poppet valve 76 on the cam-follower shaft when the spray head assembly is in operation. The O-ring 77 is first snapped into a groove 93 in a face of the poppet valve 76 which gets wider toward its bottom before the poppet valve 76 is adhered to the cam-follower shaft 74. In another embodiment the O-ring is integral with the poppet valve 76 as described below.

To use the spray head assembly 10, a threaded end 88 of the water-supply pipe 24 is attached to a pressurized water-supply. This water, and the spring 84 drive the poppet valve 76 upwardly to the closed position shown in FIG. 2 with the O-ring 77 seated on the valve-seat surface 80. When one wishes to spray with the spray head assembly 10, he encloses the housing shell 12 with his hand, his fingers being on the handle 48. He depresses the handle 48 to place the handle, for example, in the position shown in FIG. 1. If desired, a locking member 90 can be used to lock the handle 48 in this position. In any event, when the handle 48 is depressed, the actuator lever arm 44 rotates about the pivot 50 so that the outer tip 54 of the actuator shaft 42 moves to the right as seen in FIGS. 1 and 2 and thereby moves the cam plate 56 in the track 58 with it. When this happens, the bevelled cam surface 70, acting in conjunction with the cam-follower surface 72, causes the cam follower 71 to move downwardly against the bias of the spring 84 and the pressure of liquid in the water-supply passageway 22 acting on the poppet valve 76. This, in turn, lifts the O-ring 77 of the poppet valve 76 from the valve-seat surface 80 to thereby allow pressurized water to flow from the water-supply passageway 22, through the valve-seat portion 78, through holes 92 (FIG. 4) in the cam follower 71, through the holes 64 and 66 in the cam plate 56 (FIG. 3), into the spray-head compartment 20. Once water is applied under pressure to the spray-head compartment 20, it is forced from the spray-head assembly through the spray pores 18 so as to be directed towards plates and the like to be washed.

When an operator has finished spraying plates, utensils, etc., he removes force from the handle 48 and, if necessary, unlocks the locking member 90. The spring 52 shoves the handle 58 in a counterclockwise direction about the pivot 50, which, in turn, moves the outer tip 54 of the actuator shaft 42 to the left as seen in FIGS. 1 and 2. This moves the cam plate 56 to the left also so that the cam surface 70 is moved to a position in which it allows the cam follower 71 to be forced upwardly by the spring 84 and water pressure until the O-ring 77 of the poppet valve 76 seats on the valve-seat surface 80. This, of course, closes the valve so that water can no longer flow from the water-supply passageway 22 into the spray-head compartment 20.

It will be appreciated that when the valve is in a closed position as depicted in FIG. 2 the poppet valve O-ring 77 is forced with significant pressure against the valve-seat surface 80 by both the spring 84 and water pressure to thereby produce a strong seal which prevents pressurized water in the water-supply passageway 22 from getting into the spray-head compartment 20 and placing pressure on the bulkhead 36 in an effort to get into the interior 34 of the housing shell 12. Not only is the spring 84 trying to close the puppet valve 76, but water pressure in the water-supply passageway 22 is also acting to keep the valve closed. However, it should be noted that the cam surface 70, and the cam-follower surface 72, which are on an angle of 13° to the horizontal as seen in FIGS. 1 and 2, provide a proper mechanical advantage so that the poppet valve 76 can be easily unseated to allow transmission of water flow into the spray-head compartment 20. That is, an operator can easily actuate the spray head assembly 10 of this invention by application of a comfortable force on the handle 48 with his fingers.

Also, it will be understood by those with ordinary skill in the art that although the actuation mechanism for the spray head assembly of this invention is quite different from that described in U.S. Pat. No. 4,527,743 of Ettlinger et al., this invention retains convenient aspects of the spray head assembly of the Ettlinger et al. patent by use of a poppet valve actuator extending into a water-supply passageway parallel with an elongated actuator lever arm. In this regard, an operator can grip both the water-supply pipe and the actuator lever arm with one hand.

In addition, by attaching the cam-follower shaft 74 to the poppet valve 76 so as to span a restricted portion of the water-supply pipe 24, a poppet valve assembly is created which can be easily and inexpensively assembled. In this regard, in spite of the fact that rotary motion of the actuator lever arm is transmitted into linear motion of the cam plate 56 in a first direction and into linear motion of the cam follower 71 and the attached poppet valve 76 in a second orthogonal direction, the spray head assembly 10 of this invention can be assembled without the necessity of unduly interlocking mechanical linkage members. That is, all of the members simply rest on one another so that undue threading or attaching of mechanical linkage members is not necessary. Thus, the spray head assembly of this invention can be assembled relatively cheaply.

While the invention has been particularly shown and described with reference to a preferred embodiment, it will be understood by those of ordinary skill in the art that various changes in form and detail may be made therein without departing from the spirit and scope of the invention.

For example, in another embodiment the poppet valve 76 is constructed as one piece with an O-ring ridge. That is, instead of having a separate O-ring 77 in a groove 93, there is a raised, annular, resilient, ridge on the surface of the poppet valve 76 facing the valve seat surface 80. The ridge is formed as part of the poppet valve 76.

The embodiments of the invention in which an exclusive property or privilege are claimed are defined as follows:

I claim:

1. A spray head assembly comprising a housing shell, a spring-biased elongated actuator lever arm including a handle on one end portion thereof and an actuator shaft at an opposite end portion thereof, means for pivotally mounting said actuator lever arm to said housing shell at a position intermediate said handle and said actuator shaft whereby said spring-biased actuator lever arm has a seesaw action responsive to manual movement of said handle, a bulkhead through which said actuator lever arm transmits motion for allowing said seesaw actuation while maintaining a water seal into a spray-head compartment into which said actuator shaft transmits motion and from which water is sprayed through water spray pores, and a water-supply pipe defining a water-supply passageway leading into said water-sealed spray-head compartment, wherein the assembly further includes:

a first motion-translator mechanism inside said water-sealed spray-head compartment for interacting with said actuator shaft to be thereby moved in a first direction in response to said seesaw action of said actuator lever arm;

a second motion-translator mechanism inside said water-sealed spray-head compartment for engaging said first-motion translator mechanism to be moved by movement of said first motion-translator mechanism in a second direction;

a poppet valve positioned inside said water-supply passageway engaged with said second motion-translator mechanism for being moved away from a valve seat for allowing flow of water from said water-supply passageway into said water-sealed spray-head compartment in response to said handle of said actuator lever arm being depressed.

2. A spray head assembly as in claim 1 wherein said actuator lever extends along said water-supply pipe, with the handle thereof being adjacent said pipe.

3. A spray head assembly as in claim 2 wherein said first motion-translator mechanism is a cam and said second motion-translator mechanism is a cam follower for being moved in response to motion of said cam.

4. A spray-head assembly as in claim 3 wherein said poppet valve is driven closed by water flow toward said spray-head compartment and is opened by movement thereof against said water flow.

5. A spray-head assembly as in claim 2 wherein said poppet valve is driven closed by water flow toward said spray-head compartment and is opened by movement thereof against said water flow.

6. A spray head assembly as in claim 1 wherein said first motion-translator mechanism is a cam and said second motion-translator mechanism is a cam follower for being moved in response to motion of said cam.

7. A spray-head assembly as in claim 6 wherein said poppet valve is driven closed by water flow toward said spray-head compartment and opened by movement thereof against said water flow.

8. A spray-head assembly as in claim 1 wherein said poppet valve is driven closed by water flow toward said spray-head compartment and is opened by movement thereof against said water flow.

* * * * *